US007908808B2

(12) United States Patent
Hundegger

(10) Patent No.: US 7,908,808 B2
(45) Date of Patent: Mar. 22, 2011

(54) ROOF, CEILING OR WALL ELEMENT

(76) Inventor: Hans Hundegger, Hawangen (DE)

( * ) Notice: Subject to any disclaimer, the term of this patent is extended or adjusted under 35 U.S.C. 154(b) by 82 days.

(21) Appl. No.: 12/264,402

(22) Filed: Nov. 4, 2008

(65) Prior Publication Data

US 2010/0107554 A1 May 6, 2010

(51) Int. Cl.
*E04F 13/00* (2006.01)

(52) U.S. Cl. ..... 52/311.3; 52/313; 52/223.7; 428/157; 428/192

(58) Field of Classification Search ..... 52/311.1, 52/311.2, 313, 592.3, 592.5, 561, 562, 223.1, 52/223.5, 223.7, 223.9, 407.3, 233, 605, 52/847, 591.4, 591.5; 428/157, 192; 144/344, 144/345, 354

See application file for complete search history.

(56) References Cited

U.S. PATENT DOCUMENTS

| | | | | | |
|---|---|---|---|---|---|
| 691,214 | A * | 1/1902 | Webb | 428/187 |
| 1,078,776 | A * | 11/1913 | Dunton | 52/313 |
| 1,102,036 | A * | 6/1914 | Ganter | 144/347 |
| 1,944,237 | A * | 1/1934 | Heineman | 52/584.1 |
| 2,037,259 | A * | 4/1936 | Murphy et al. | 52/313 |
| 2,271,443 | A * | 1/1942 | Schuh | 428/113 |
| 3,172,170 | A * | 3/1965 | Webster | 52/585.1 |
| 3,503,833 | A * | 3/1970 | Carlson | 428/56 |
| 3,605,360 | A * | 9/1971 | Lindal | 52/223.8 |
| 4,442,149 | A * | 4/1984 | Bennett | 428/53 |
| 5,026,593 | A * | 6/1991 | O'Brien | 428/215 |
| 5,135,597 | A * | 8/1992 | Barker | 156/264 |
| 5,400,845 | A * | 3/1995 | Choiniere et al. | 144/353 |
| 5,493,830 | A * | 2/1996 | Saarelainen | 52/233 |
| 6,217,976 | B1 * | 4/2001 | Macpherson et al. | 428/106 |
| 6,256,949 | B1 * | 7/2001 | Meierhofer | 52/223.1 |
| 6,722,093 | B2 * | 4/2004 | Dauplay | 52/314 |
| 2004/0025970 | A1 * | 2/2004 | Sing | 144/345 |

FOREIGN PATENT DOCUMENTS

| | | | |
|---|---|---|---|
| DE | 9415235.7 | G | 2/1995 |
| DE | 195 37 298 | A1 | 4/1997 |
| DE | 19537298 | A1 * | 4/1997 |
| DE | 101 37 062 | A1 | 2/2003 |
| DE | 198 18 525 | B4 | 11/2004 |

* cited by examiner

*Primary Examiner* — Robert J Canfield
*Assistant Examiner* — Babajide Demuren
(74) *Attorney, Agent, or Firm* — Martin Fleit; Paul D. Bianco; Fleit Gibbons Gutman Bongini & Bianco PL

(57) ABSTRACT

The invention relates to a roof, ceiling or wall element (1) made of several successive superposed layers of wooden boards (2; 2*a*, 2*b*), where the wooden boards (2; 2*a*, 2*b*) of the successive superposed layers lie on top of each other with their broad surfaces (3) facing, and the wooden boards (2; 2*a*, 2*b*) of a layer are connected to the wooden boards (2; 2*a*, 2*b*) of at least the abutting layer by holding elements (4). A cost effective manufacture with small loss of material can be achieved by the fact that the wooden boards (2; 2*a*, 2*b*) on the mutually facing broad surfaces (3) are unplaned, and at least the small surfaces (8) of the wooden boards (2; 2*a*, 2*b*), which surfaces form a visible side of the roof, ceiling or wall element (1), are stepped at their edges with an upper and lower notch (9, 10).

9 Claims, 2 Drawing Sheets

ROOF, CEILING OR WALL ELEMENT

FIELD OF THE INVENTION

The invention relates to a roof, ceiling or wall element consisting of several successive superposed layers of wooden boards, where the wooden boards of the successive superposed layers lie on top of each other with their broad sides, and the wooden boards of a layer are connected to the wooden boards of at least the abutting layer by holding elements.

BACKGROUND OF THE INVENTION

Such roof, ceiling or wall elements can be manufactured cost effectively, but they often have to be worked on further to produce smooth visible surfaces. For example, if, in the manufacture of such roof, ceiling or wall elements, wooden boards are used that are unplaned on the mutually facing broad sides, then irregular cracks can occur at the margins, which are undesirable particularly on the visible side. In addition, as a rule, wood fibers or wood splinters then protrude at the margin conferring an unattractive appearance to the roof, ceiling or wall element. To prevent this, the boards are frequently planed on their broad sides, but this requires a considerable manufacturing cost. In addition, planing the boards on the broad sides leads to a considerable loss of material.

The problem of the invention is to produce cost effectively a roof, ceiling or wall element of the type mentioned in the introduction, which can be manufactured with small loss of material from simple wooden boards.

SUMMARY OF THE INVENTION

This problem is solved by a roof, ceiling or wall element having the characteristics of Claim 1. Advantageous embodiments and advantageous variants of the invention are the object of the dependent claims.

Because, in the roof, ceiling or wall element according to the invention, the wooden boards are unplaned on the mutually facing broad surfaces, it is possible not only to reduce the manufacturing cost but also to prevent any loss of material in the thickness direction due to the planing. By means of the special profiling of the wooden boards on the visible side of the roof, ceiling or wall element, one achieves in addition that the contacting edges of the successive wooden boards and an irregular slit that may be present there due to the roughness of the unplaned broad surfaces can be shifted backward and thus not be visible easily from outside. The wood fibers or wood splinters that usually also protrude at the contacting edges between the wooden boards are also shifted inward and are not visible. As a result, a large-surface roof, ceiling or wall element can be manufactured that presents a visually attractive, even, visible surface, in a relatively simple way from wood boards with unplaned broad surfaces that are stacked on top of each other.

In an embodiment that is advantageous from the point of view of manufacturing technology, upper and lower notches of the wooden boards are shaped as rectangular recesses on at least one surface that runs in the longitudinal direction of the wooden boards, so that two superposed boards form an inwardly directed groove, by means of which the contacting edges of the wooden boards can be shifted backward. The stepped smooth small surface with the upper and lower notches can be manufactured on a wooden board advantageously using a profiled plane or a profiled cutter in one work step.

To achieve a clean and even, visible surface with roof elements made of 20- to 25-mm thick wooden boards that are unplaned on the broad sides, it has been found useful to use, for example, a groove width B of 2-10 mm and a groove depth T of 3-15 mm.

The roof, ceiling or wall element can be constructed from identically broad wooden boards, or from broader wooden boards and several smaller interspersed wooden boards, so that between the broader wooden boards a reception space for filler or insulation material is formed. The reception spaces can be filled, for example, with concrete, resulting in the manufacture of a composite part having good bearing and rigidity properties.

In the case of long roof, ceiling or wall elements it is advantageous to arrange within one layer several identical length or different length wooden boards face to face. However, the individual layers can also present only one wooden board each.

BRIEF DESCRIPTION OF THE DRAWINGS

Additional special features and advantages of the invention can be obtained from the following description of a preferred embodiment in reference to the drawing. In the drawing.

DETAILED DESCRIPTION OF THE INVENTION

Figure 1:
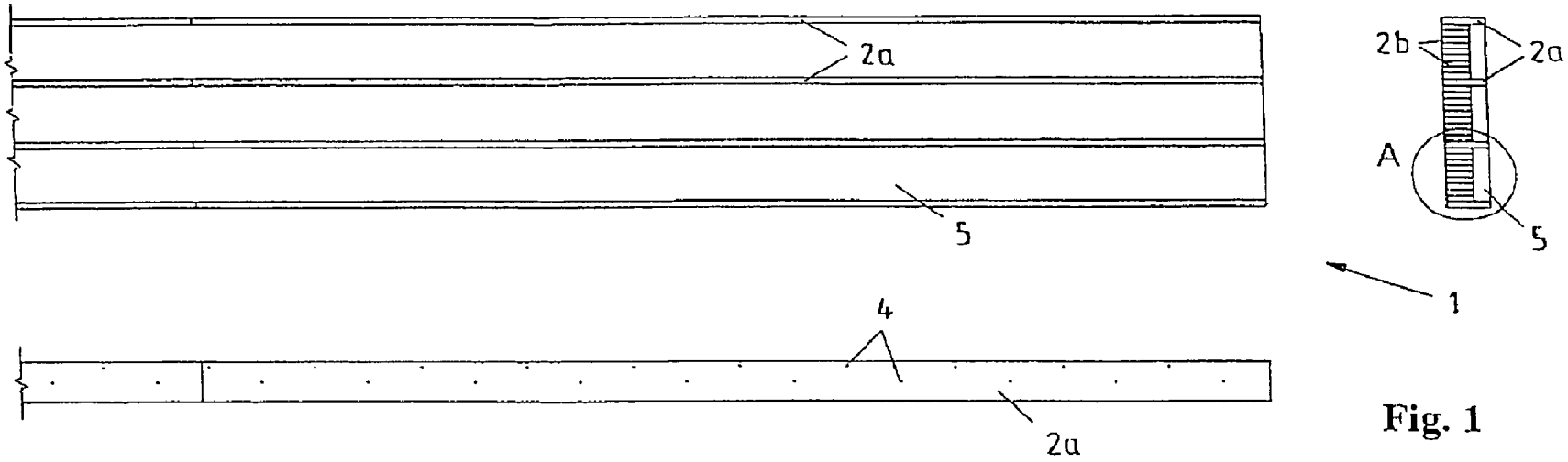
FIG. 1 shows a roof, ceiling or wall element manufactured from wooden boards in a front, side and top view.
Figure 2:
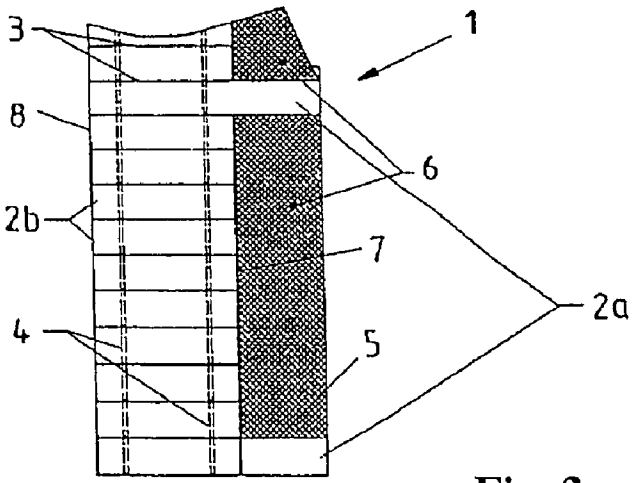
FIG. 2 shows an enlarged representation of area A of FIG. 1.

In FIGS. 1 and 2, a roof, ceiling or wall element 1 is shown, which consists of several successive superposed layers of wooden boards 2*a* and 2*b*. The wooden boards 2*a* and 2*b* of the successive superposed layers lie with their mutually facing unplaned broad surfaces 3 on top of each other and they are interconnected, for example, with holding elements 4 in the form of threaded nails. In the embodiment shown in FIGS. 1 and 2, the roof, ceiling or wall element 1 consists of broader wooden boards 2*a* and several smaller wooden boards 2*b* interspersed between them, so that a reception space 5 for a filler or insulation material 6 exists between the broader wooden boards 2*a*. In the shown embodiment example, the wooden boards 2*a* and 2*b* terminate flush, for example, on the front visible side, and the reception spaces 5 located on the back side between the broader wooden boards 2*a* are filled with concrete. As a result, a composite component can be produced with good rigidity and bearing properties. The roof, ceiling or wall element 1 can, however, also be manufactured as a purely wooden component made of identically broad wooden boards 2, as represented in FIG. 3.

Figure 3:
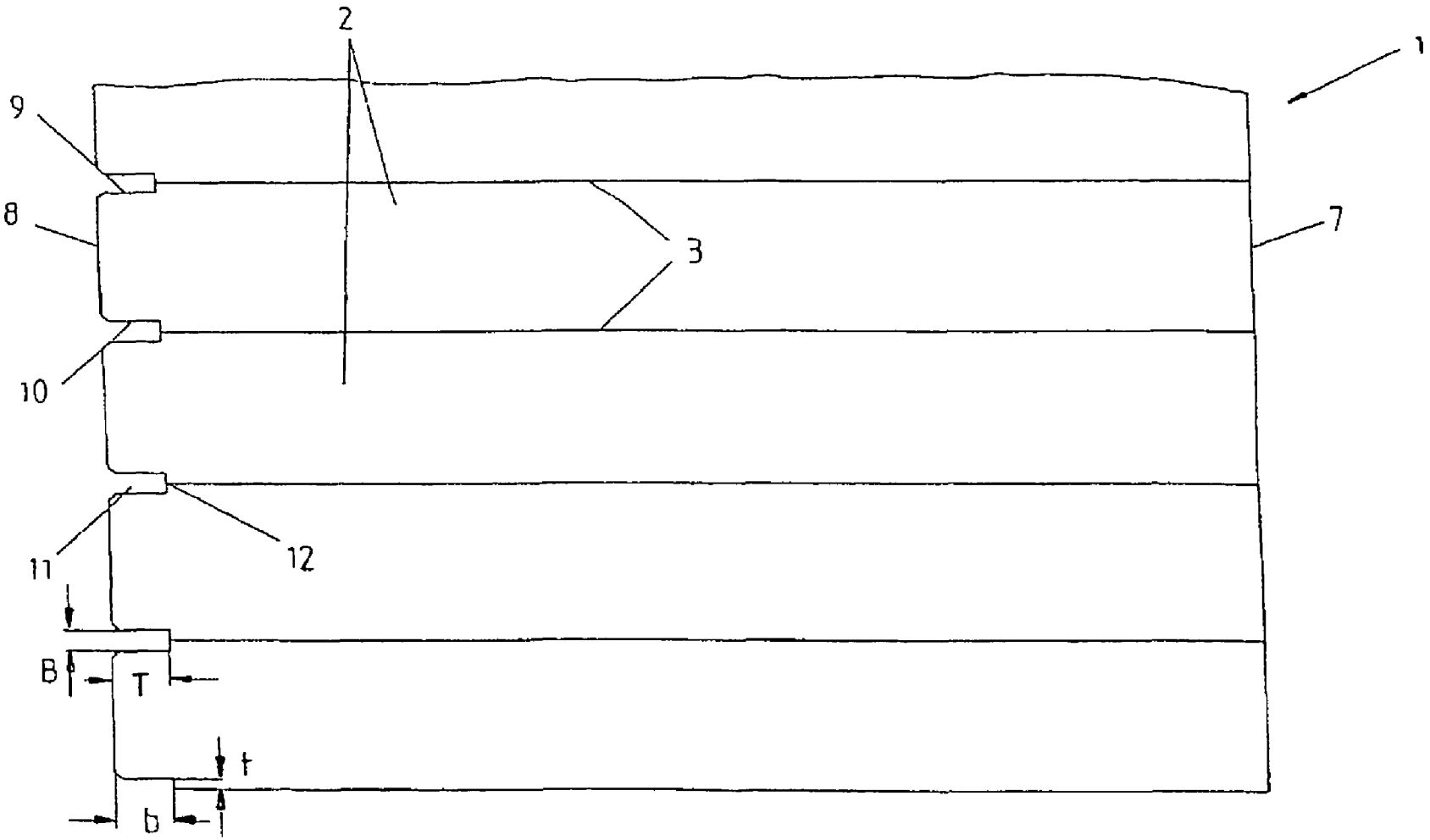
FIG. 3 shows an enlarged view of a roof, ceiling or wall element in a side view.

As is evident from FIG. 3, the wooden boards 2, which are unplaned on the broad surfaces 3, of the roof, ceiling or wall element 1 shown here, present on their longitudinal sides smooth small surfaces 7 and 8 produced, for example, by planing. The small surfaces 7 of the wooden boards 2, on the right in FIG. 3, are straight, while the left small surfaces 8 of the wooden boards 2, which form a visible side of the roof, ceiling or wall element 1, are stepped at their edges with an upper and a lower notch 9 and 10. Advantageously, the wooden boards 2 are processed on this side with a profiled plane or a profiled cutter, which produces the stepped smooth small surface 8 together with the upper and lower notch 9 and 10 formed as rectangular recesses in one work step. The two notches 9 and 10 of the mutually abutting wooden boards 2 thus form a groove 11 which is open toward the visible side, by means of which the contacting edges 12 of the wooden boards 2 and a slit that may be present there are shifted inward. A slit that is present on the contacting edges 12 due to the roughness of the unplaned broad surfaces 3 and wood fibers or wood splinters that protrude there are therefore not visible from the outside. In the case of 20- to 25-mm thick wooden boards that are unplaned on the broad surfaces, it has been found that, for example, a notch width b of 3-15 mm and a notch depth t of 1-5 mm are advantageous to achieve a clean and uniform, visible surface for roof, ceiling or wall elements manufactured therefrom. The grooves 11 formed by the notches 9 and 10 present accordingly a groove depth T of 3-15 mm and a groove width B of 2-10 mm.

In the enlarged detail of FIG. 2 one can see that the wooden boards 2 of in each case one layer are connected to the wooden boards 2 of the subsequent layer by means of the holding elements 4. The latter are shifted diagonally according to FIG. 1, and are mutually offset from layer to layer also in the longitudinal direction of the wooden boards 2. The holding elements 4 can here engage not only in the wooden boards 2 of the abutting layer but also in the wooden boards 2 of the underlying layer. The holding elements 4 consist advantageously of a light metal, or plastic, so that the roof, ceiling or wall element 1 can also be further processed without damaging the sensitive wood machining tools. The holding elements 4 are advantageously in the form of nails with or without a head, but they can also be designed as clamps, staples or similar parts. They can be manufactured, for example, from an aluminum wire, which is wound on a roll or a coil. With the help of a special device, the wire can be unwound from the roll or coil, stretched or straightened, and cut to the desired length. Holding elements 4 that have been manufactured in this way can then be transported without additional machining expense in a magazine of a nail driving device, and they can be driven into the wooden boards 2, for example, with the help of pressurized air.

The manufacture of a roof, ceiling or wall element 1 as described above can occur by the application first of a layer with one or more mutually contacting wooden boards 2, on an application table or a support. Said wooden boards 2 are pressed by an appropriate compression device against the previously processed small surface 8 that forms the visible surface of the roof, ceiling or wall element, at a lateral stop. Then, a second board layer is applied onto the first layer. If the first board layer consists of several successive wooden boards 2, then the face surfaces of the wooden boards 2 are mutually offset in the successive superposed layers. The wooden boards 2 of the second layer as well are then applied by pressure using the compression device against the lateral stop, so that the superposed wooden boards 2 are aligned with the small surfaces 8. Using a tension device, the upper wooden boards 2 are then pressed with their broad sides 3 against the lower wooden boards 2 and connected to the latter, for example, with holding elements 4 in the form of threaded nails. The holding elements 4 are introduced, for example, with an automatically controlled nail driving device. For this purpose, the width of the boards and their position during the application are determined by appropriate measuring devices. From the data so determined, the precise position of the holding elements 4 can be determined, and the positioning of the automatic nail device can be controlled in such a way that the holding elements introduced in the different layers do not contact each other. In a similar way, additional board layers can then be applied, and connected to each other by means of additional holding elements 4, until a desired dimension of the roof, ceiling or wall element is achieved.

The invention claimed is:

1. A roof, ceiling or wall element (1) made of several successive superposed layers of wooden boards (2; 2*a*, 2*b*), where the wooden boards (2; 2*a*, 2*b*) of the superposed layers lie on top of each other with their broad surfaces facing (3), and the wooden boards (2; 2*a*, 2*b*) of a layer are connected to the wooden boards (2; 2*a*, 2*b*) of at least an abutting layer by holding elements (4), wherein the wooden boards (2; 2*a*, 2*b*) on mutually facing broad surfaces (3) are unplaned, and at least small surfaces (8) forming a visible side of the roof, ceiling or wall element (1), of the wooden boards (2; 2*a*, 2*b*), are stepped at their edges with an upper and lower notch (9, 10) and wherein the upper and lower notches (9, 10) of the wooden boards (2, 2*a*, 2*b*) of two successive superposed layers form a groove (11) that is directed inward, by means of which contacting edges (12) of the wooden boards (2, 2*a*, 2*b*) are shifted inward and wherein the inward shifting of the contacting edges (12) conceals from the visible side gaps and other imperfections resulting from the unplaned mutually facing broad surfaces (3) of the wooden boards (2, 2*a*, 2*b*).

2. The roof, ceiling or wall element according to claim 1, wherein the wooden boards (2; 2*a*, 2*b*) of the successive superposed layers present identical or different widths.

3. The roof, ceiling or wall element according to claim 1, wherein several layers of wooden boards (2*b*) with smaller width are arranged between wooden boards (2*a*) with larger width.

4. The roof, ceiling or wall element according to claim 1, wherein several wooden boards (2; 2*a*, 2*b*) are arranged in mutual contact in the successive superposed layers face to face.

5. The roof, ceiling or wall element according to claim 1, wherein the upper and lower notches (9, 10) are arranged on at least one of a long small side (8) of the wooden boards (2; 2*a*, 2*b*).

6. The roof, ceiling or wall element according to claim 1, wherein the upper and lower notches (9, 10) present a notch width b of 3-15 mm and a notch depth t of 1-5 mm.

7. The roof, ceiling or wall element according to claim 1, wherein the holding elements (4) are designed in a form of a nail or a clamp.

8. The roof, ceiling or wall element according to claim 1, wherein the holding elements (4) are made of aluminum.

9. The roof, ceiling or wall element according to claim 1, wherein within one layer identical length or different length wooden boards (2; 2*a*, 2*b*) are arranged face to face.

* * * * *